US005584947A

United States Patent [19]

Raymond et al.

[11] Patent Number: 5,584,947

[45] Date of Patent: Dec. 17, 1996

[54] METHOD FOR FORMING A NICKEL-BASE SUPERALLOY HAVING IMPROVED RESISTANCE TO ABNORMAL GRAIN GROWTH

[75] Inventors: Edward L. Raymond, Maineville; Robert D. Kissinger, Reading; Allen J. Paxson, Cincinnati; Eric S. Huron, West Chester, all of Ohio

[73] Assignee: General Electric Company, Cincinnati, Ohio

[21] Appl. No.: 293,343

[22] Filed: Aug. 18, 1994

[51] Int. Cl.[6] ..... C22F 1/10

[52] U.S. Cl. ..... 148/556; 148/677; 419/29; 419/28

[58] Field of Search ..... 419/41, 67, 28, 419/29, 42; 148/675, 676, 677, 556, 428, 410

[56] References Cited

U.S. PATENT DOCUMENTS

| | | | |
|---|---|---|---|
| 4,877,435 | 10/1989 | Haeberle et al. | 148/410 |
| 4,957,567 | 9/1990 | Krueger et al. . | |
| 5,061,324 | 10/1991 | Chang | 148/675 |
| 5,080,734 | 1/1992 | Krueger et al. | 148/410 |
| 5,143,563 | 9/1992 | Krueger et al. | 148/410 |
| 5,393,483 | 2/1995 | Chang | 148/428 |
| 5,413,752 | 5/1995 | Kissinger et al. | 419/28 |

OTHER PUBLICATIONS

Chang, K. M. and Fiedler, H. C. Conference: Superalloys 1988 "Spray Formed High Strength Superalloys" pp. 485–493.

*Primary Examiner*—David A. Simmons
*Assistant Examiner*—Margery S. Phipps
*Attorney, Agent, or Firm*—Andrew C. Hess; David L. Narciso

[57] ABSTRACT

A method is provided for obtaining uniform grain growth within $\gamma'$ precipitation strengthened nickel-base superalloys provided in powder metal or cast and wrought form. The method includes alloying the nickel-base superalloy to contain a minimum calculated amount of carbon which, when finely dispersed within the alloy using suitable processing methods, yields a sufficient amount of carbide phase which restricts the grain boundary motion of the alloy during supersolvus heat treatment. When appropriately processed, the grains are not permitted to grow randomly during supersolvus heat treatment, making possible a microstructure whose grain size is uniform, having a grain size range of about 2 to about 3 ASTM units and being substantially free of random grain growth in excess of about 2 ASTM units coarser than the desired grain size range.

15 Claims, No Drawings

METHOD FOR FORMING A NICKEL-BASE SUPERALLOY HAVING IMPROVED RESISTANCE TO ABNORMAL GRAIN GROWTH

This invention relates to nickel-base superalloys. More particularly, this invention is directed to a nickel-base superalloy which is alloyed so as to suppress abnormal grain growth in the alloy during supersolvus heat treatment of the alloy.

BACKGROUND OF THE INVENTION

The material requirements for gas turbine engines are continually being increased. Components formed from powder metal gamma prime ($\gamma'$) precipitation strengthened nickel-base superalloys can provide a good balance of creep, tensile and fatigue crack growth properties to meet these performance requirements. Typically, a powder metal component is produced by consolidating metal powders in some form, such as extrusion consolidation, then isothermally forging the consolidated material to the desired outline, and finally heat treating the forging. The processing steps of consolidation and forging are designed to retain a very fine grain size within the material, so as to minimize die loading and improve shape definition. In order to improve the fatigue crack growth resistance and mechanical properties of these materials at elevated temperatures, these alloys are then heat treated above their $\gamma'$ solvus temperature (generally referred to as supersolvus heat treatment), to cause significant, uniform coarsening of the grains.

However, during conventional manufacturing procedures involving hot forging operations, a wide range of local strains and strain rates may be introduced into the material which result in non-uniform critical grain growth during post forging supersolvus heat treatment. Critical grain growth is defined as localized abnormal excessive grain growth to grain diameters exceeding the desired range, which is preferably between about ASTM 7 and ASTM 8 for some gas turbine engine components. (Reference throughout to ASTM grain sizes is in accordance with the standard scale established by the American Society for Testing and Materials.)

In particular, random grain growth of greater than about ASTM 4 is undesirable in that it may significantly reduce the low cycle fatigue resistance of the component and may have a negative impact on other mechanical properties of the component, such as tensile and fatigue strength. Therefore, large grains of this size are to be avoided. The propensity for critical grain growth increases if more conventional cast and wrought billet processing techniques and conventional forging techniques are used to form such components. As such, critical components are generally formed from powder metallurgy particles which have been extrusion consolidated. However, even these components are more susceptible to critical grain growth during supersolvus heat treatment if formed by friction welding two or more components together, as in the case of some turbine disks.

U.S. Pat. No. 4,957,567 to Krueger et al., assigned to the same assignee of the present patent application, eliminates critical grain growth in fine grain nickel-base superalloy components by controlling the localized strain rates experienced during the hot forging operations. Krueger et al. teach that, generally, local strain rates must remain below a critical value, $\dot{\varepsilon}_c$, in order to avoid detrimental critical grain growth during subsequent supersolvus heat treatment. Strain rate is defined as the instantaneous rate of change of strain with time.

However, it is apparent that critical grain growth has a tendency to occur unless the processing parameters of the alloy during forging and heat treatment are properly controlled. As such, the process window for many components is narrow, resulting in increased costs due to scrappage. Accordingly, it would be desirable to provide a nickel-base superalloy having enhanced processability in order to achieve desirable microstructures within commercially attainable processing parameters.

SUMMARY OF THE INVENTION

It is therefore an object of this invention to provide a precipitation strengthened nickel-base superalloy which is alloyed so as to minimize nucleation tendencies and to control grain growth in the alloy during supersolvus heat treatment.

It is a further object of this invention that the superalloy include second phase particles within narrow compositional ranges, in which the second phase particles serve to prevent critical grain growth by pinning the grain boundaries of the superalloy, such that a relatively wide range of processing conditions are possible while still avoiding critical grain growth in the superalloy.

It is another object of this invention that such a superalloy enable the use of commercially attainable processing parameters in order to form forged articles therefrom.

Lastly, it is yet another object of this invention that such methods be adaptable for working precipitation strengthened nickel-base superalloys, having about 30–65 volume percent $\gamma'$ content, so as to form articles which may be useful, after appropriate heat treatment, at temperatures of up to about 1400° F.

A method is provided for obtaining uniform grain growth within $\gamma'$ precipitation strengthened nickel-base superalloys provided in powder metal or cast and wrought form. This method is particularly useful for forming components such as gas turbine compressor and turbine disk assemblies in which high localized strain rates commonly occur during a hot forging operation in which the components are formed.

The method of this invention includes alloying the nickel-base superalloy with a sufficient amount of carbon above the solubility level of the alloy, so as to form a sufficient amount of a carbide phase within the alloy. In accordance with this invention, it has been determined that the presence of carbides at sufficient levels will result in the pinning of the grain boundaries, such that critical grain growth is prevented during supersolvus heat treatment. In particular, a sufficient carbon content is required which, when finely dispersed within the alloy using suitable processing methods, will yield carbide particles in quantities sufficient to restrict excessive local grain boundary motion of the alloy during supersolvus heat treatment. Notably, the mere presence of carbides in a nickel-base superalloy does not ensure the results achieved by this present invention—only when the carbides are present in sufficient quantities and maintained in a suitably refined dispersion as enabled by a minimum carbon content will critical grain growth be prevented.

A preferred nickel-base superalloy has a calculated $\gamma'$ content in the range of about 30 to about 65 volume percent. Dispersion of the carbide phase can be achieved by rapid cooling a melt of the alloy, as with powder metallurgy techniques or spraycast forming techniques, or with extensive heating and working of a cast and wrought structure.

Due to the presence of the finely dispersed carbide phase, the grains are not permitted to grow randomly during supersolvus heat treatment, making possible a microstructure whose grain size is uniform. As used here, the term "uniform" with respect to grain size and growth means the substantial absence of critical grain growth. For example, if a grain size of between about ASTM 7 and ASTM 9 is desired, the method of this invention is capable of preventing grains of larger than about ASTM 4. Similarly, if a grain size of between about ASTM 2 and ASTM 4 is desired, the method of this invention is capable of preventing grains of larger than about ASTM 00.

The method of this invention entails processing steps which are less restrictive than that required under the teachings of Krueger et al. due to this invention's inclusion of higher levels of carbon to achieve the desired microstructure for the alloy. Initial processing of the alloy is performed so as to form a billet having a fine grain size of about ASTM 10 or finer in order to achieve optimum superplasticity during forging. If the initial form of the alloy is a powder metallurgy powder, this initial processing step may be an extrusion consolidation step whose parameters are established within a narrow range for temperature and ram speed or, alternatively, a step involving hot isostatic pressing (HIP) consolidation plus press forge working, again with parameters established within a suitably narrow range to produce a billet. The billet is then worked, such as by forging, at a temperature below the $\gamma'$ solvus temperature of the alloy, so as to maintain a grain size of not larger than about ASTM 10, while forming precipitates which include $\gamma'$ and maintaining a refined carbide dispersion. During working, local strain rates within the article are maintained below a critical strain rate for random grain growth. After working, a supersolvus heat treatment is performed by heating the resultant worked article to a temperature above the $\gamma'$ solvus temperature of the superalloy so as to solution substantially all of the $\gamma'$ but not the carbides, and for a duration sufficient to uniformly coarsen the grains of the article to at least about ASTM 9.

Due to the presence of the carbide phase in the superalloy, random grain growth is prevented so as to yield a maximum grain size of not more than several ASTM units below the desired grain size. Thereafter, the article is cooled at a rate sufficient to reprecipitate $\gamma'$ within the article at a size and interparticle spacing to achieve a desired strength level.

The method of this invention results in superalloy articles characterized by a combination of high strength and tolerance to defects, and which are suitable for use over a temperature range of up to about 1400° F. Yet, due to an enhanced resistance to critical grain growth, the superalloy articles can be processed with a wider processing window so as to achieve lower part rejection and scrap rate during production. Furthermore, articles which typically have been limited to processing by powder metallurgy techniques may now be formed by conventional cast and wrought processing and spraycast forming techniques.

DETAILED DESCRIPTION OF THE INVENTION

For $\gamma'$ precipitation strengthened nickel-base superalloys, aluminum and titanium are the principal elements which combine with nickel to form the desired amount of $\gamma'$ precipitate, principally $Ni_3(Al,Ti)$. The elements nickel, chromium, tungsten, molybdenum and cobalt are the principal elements which combine to form the $\gamma$ matrix. The principal high temperature carbide formed is of the MC type, in which M is predominantly niobium, zirconium and titanium. With this type of alloy, prior art processing methods have employed working parameters which provide a worked structure having a grain size of not larger than about ASTM 10. After supersolvus heat treating, such worked structures would have a grain size on the order of about ASTM 2 to about ASTM 9.

It has been determined that grain growth during the supersolvus heat treatment of a forged component is dependent on the strain rates experienced by the component during the preceding hot working operation. The strain rate experienced during hot deformation (i.e., temperatures at or near the alloy's recrystallization temperature but less than the alloy's $\gamma'$ solvus temperature) of a $\gamma'$ precipitation strengthened nickel-base superalloy material is crucial to the development of beneficial, uniform grain growth within the material during subsequent supersolvus heat treatment.

As previously taught by Krueger et al, which is incorporated herein by reference, the strain rate experienced during hot deformation must remain below a relatively low critical strain rate, $\dot{\varepsilon}_c$, so as to avoid non-uniform critical grain growth. Yet, critical grain growth may still occur if the other processing parameters during forging and heat treatment are not properly controlled.

As a method by which the strain rate range of a $\gamma'$ precipitation strengthened nickel-base superalloy can be widened in order to facilitate production while maintaining a desired microstructure, the present invention employs a level of carbon in a $\gamma'$ precipitation strengthened nickel-base superalloy which, in the form of finely dispersed carbides, serves to minimize nucleation tendencies and control grain growth during supersolvus heat treatment of the superalloy, such that critical grain growth is substantially prevented.

Generally, a minimum carbon content has been determined to be necessary to yield a sufficient carbide phase to significantly control grain growth. The minimum required carbon content is dependent in part on the solubility product of titanium and carbon, as will be discussed below. Depending on the titanium content of the alloy, a carbon content of at least about 0.030 weight percent, and preferably at least about 0.045 weight percent, has been determined to be required. A suitable upper limit for the carbon content is believed to be about 0.11 weight percent, with this limit being generally limited only by the potential detrimental impact of excessive carbon on other properties of the superalloy. The presence of carbon above the minimum level is believed to provide a sufficient pinning force so as to prevent abnormal grain growth. Generally, with this invention, the finely dispersed carbides restrict grain boundary motion during supersolvus heat treatment, such that the grains are not permitted to grow excessively and/or randomly.

While the teachings of this invention are applicable to $\gamma'$ precipitation strengthened nickel-base superalloys in general, representative superalloys suitable for illustrating the advantages of this invention are disclosed in U.S. Pat. Nos. 4,957,567, 5,080,734 and 5,143,563, all of which are assigned to the assignee of this invention. The nominal compositions of four superalloys disclosed by these patents are provided below. However, the scope of this invention is not limited to these or any other specific compositions, but rather is directed to all $\gamma'$ precipitation strengthened nickel-base superalloys.

TABLE I

| ELEMENT | ALLOY A | ALLOY B | ALLOY C | ALLOY D |
|---|---|---|---|---|
| Cobalt | 17.0–19.0 | 10.9–12.9 | 16.0–18.0 | 12.0–14.0 |
| Chromium | 11.0–13.0 | 11.8–13.8 | 14.0–16.0 | 15.0–17.0 |
| Molybdenum | 3.5–4.5 | 4.6–5.6 | 4.5–5.5 | 3.5–4.5 |
| Tungsten | — | — | — | 3.5–4.5 |
| Aluminum | 3.5–4.5 | 2.1–3.1 | 2.0–3.0 | 1.5–2.5 |
| Titanium | 3.5–4.5 | 4.4–5.4 | 4.2–5.2 | 3.2–4.2 |
| Niobium | 1.5–2.5 | 1.1–2.1 | 1.1–2.1 | 0.5–1.0 |
| Hafnium | — | 0.1–0.3 | — | to 0.3 |
| Vanadium | — | — | — | to 0.01 |
| Zirconium | to 0.06 | to 0.06 | 0.04–0.08 | 0.01–0.06 |
| Carbon | 0.01–0.06 | 0.01–0.06 | 0.04–0.08 | 0.01–0.06 |
| Boron | 0.01–0.04 | 0.005–0.025 | 0.02–0.04 | 0.01–0.04 |
| Yttrium | — | — | — | to 0.01 |
| Nickel | Balance | Balance | Balance | Balance |

The recrystallization temperature for each of these alloys is approximately 1900° F., and the $\gamma'$ solvus temperature is estimated to be in the range of about 2030° F.–2200° F., typically in the range of about 2120° F.–2180° F. for about 54 volume percent $\gamma'$. The calculated $\gamma'$ content varies from about 43 to about 61 volume percent. The supersolvus solution temperature for an alloy is typically about 50° F. above its $\gamma'$ solvus temperature.

Notably, each of the above alloys disclose the use of carbon within a range that overlaps the carbon range deemed necessary by the present invention. However, these alloys also permit carbon levels which are well below that required by the present invention, in that the ability for a carbide phase to pin the grain boundaries of a nickel-base superalloy was unknown and unexpected during the development of these prior art alloys. Therefore, a critical and novel feature of this invention is the identification of carbon as a primary factor in the control of critical grain growth in nickel-base superalloys.

More specifically, in accordance with this invention, a nickel-base superalloy must contain sufficient excess carbon over its solubility level within the alloy, so as to form carbides within the alloy at a sufficient level to pin the grain boundaries and thereby prevent critical grain growth during supersolvus heat treatment. In particular, at least about 0.030 weight percent carbon in certain nickel-base superalloys will, when finely dispersed within the alloy using suitable processing methods, yield a sufficient amount of carbide phase to restrict the grain boundary motion of the alloy during supersolvus heat treatment. It has been found that the absolute minimum carbon content required depends on the superalloy and particle size such that a minimum of about 10 percent of the prior particle boundary area is covered with fine high temperature carbides of the MC type, in which M is predominantly niobium and titanium. Some M23C6 and M6C carbides are present as well, where M is molybdenum or chromium, though the aforementioned MC carbides serve as the primary pinning phase. The heat treatment and processing must achieve the desired distribution of carbon between the MC carbides and the other carbides. This is achieved by processing within defined temperature limits.

The minimum amount of carbon to form the required amount of carbide phase and achieve the necessary prior particle boundary area coverage is a function of alloy composition. Alloys A, B and C in Table I are higher $\gamma'$ content alloys. This is achieved in part by higher titanium levels. Because of their increased titanium levels, these alloys require less carbon to achieve the same level of carbide phase. In accordance with this invention, a minimum solubility product for MC carbides, defined as %Ti×%Nb×(activity factor for Nb)×%C (where percents are in weight percents) is necessary to achieve the required effect. The experimentally determined minimum value for the solubility product is about 0.16. As examples, the same solubility product can be achieved for about 0.045 weight percent carbon with about 3.7 weight percent titanium and about 0.7 weight percent niobium in Alloy D, or with about 0.030 weight percent carbon with about 4 weight percent titanium and about 2 weight percent niobium in Alloy A.

Accordingly, a level of at least about 0.045 weight percent carbon is required to cover 10 percent of the prior particle boundary area of Alloy D of Table I with the desired MC carbides. This level of particle boundary area has been shown to have a wide forging process window to avoid critical grain growth, as a result of the stable carbides preventing uncontrolled grain growth. However, a carbon level of 0.036 weight percent results in only about 5 percent of the prior particle boundary area being covered, resulting in the requirement for a much narrower forging window in order to avoid critical grain growth. In alloys such as Alloys A, B and C, a carbon level of about 0.030 weight percent has been shown to provide protection against critical grain growth, while a carbon level of about 0.015 weight percent results in critical grain growth and a narrower process window.

For some applications, optimum mechanical properties are achieved by uniform grain sizes between about ASTM 7 and ASTM 8, while grain sizes of larger than about ASTM 4 are undesirable in that the presence of such grains can significantly reduce the low cycle fatigue resistance of the component and can have a negative impact on other mechanical properties of the component, such as tensile and fatigue strength. However, for other applications, grain sizes on the order of about ASTM 2 to about ASTM 4 are desirable to achieve enhanced creep capabilities, while grain sizes on the order of about ASTM 00 are to be avoided.

Therefore, an object of this invention is to achieve a uniform grain size within a nickel-base superalloy, in which random grain growth is prevented so as to yield a maximum grain size of not more than several ASTM units below the desired grain size. More particularly, a nickel-base superalloy processed in accordance with this invention is preferably characterized by uniformly coarse grains having a grain size range of about 2 to about 3 ASTM units and being substantially free of random grain growth in excess of about 3 to 5 ASTM units coarser than the grain size range.

Due to high levels of carbon, the processing parameters required to prevent critical grain growth during the supersolvus heat treatment are much wider than would otherwise be permitted under the critical grain growth restrictions taught by Krueger et al. For example, the critical strain rate, $\dot{\varepsilon}_c$, is considerably higher for Alloy D modified to have a carbon content of 0.045 weight percent in comparison to a carbon content of 0.030 weight percent, such that near-net shaped forgings can be produced more reliably, and at higher production rates.

A suitable process involves forming a billet having a grain size of about ASTM 10 or finer from a nickel-base superalloy in order to achieve optimum superplasticity. After hot working, the superalloy structure is fully solutioned, except for the high temperature carbides, at a supersolvus temperature while the worked grain structure simultaneously recrystallizes and coarsens uniformly to the desired grain size. More particularly, the article is heated above the alloy's $\gamma'$ solvus temperature but below the alloy's incipient melting temperature. The supersolvus solution temperature for an alloy is typically about 50° F. above its $\gamma'$ solvus temperature. Following the supersolvus heat treatment, the cooling rate is then appropriately controlled to reprecipitate γ' within the γ matrix, so as to achieve the particular mechanical properties desired.

In a specific example, a γ' precipitation strengthened nickel-base superalloy identified as Alloy D in Table I is alloyed to contain additions of carbon to have a nominal composition, in weight percent, of about 12.0 to about 14.0 cobalt (Co), about 15.0 to about 17.0 chromium (Cr), about 3.5 to about 4.5 molybdenum (Mo), about 1.5 to about 2.5 aluminum (Al), about 3.2 to about 4.2 titanium (Ti), about 0.5 to about 1.0 niobium (Nb), about 0.01 to about 0.06 zirconium (Zr), about 0.045 to about 0.11 carbon (C), about 0.01 to about 0.04 boron (B), up to about 0.3 hafnium (Hf), up to about 0.01 vanadium (V), and up to about 0.01 yttrium (Y), with the balance being essentially nickel (Ni) and incidental impurities.

The recrystallization temperature of Alloy D is approximately 1900° F., and its γ' solvus temperature is estimated to be in the range of about 2000° F.–2100° F., typically in the range of about 2025° F.–2050° F., for about 40 volume percent γ'. The calculated γ' content for this alloy is from about 33 to about 46 volume percent. The incipient melting point is estimated to be in the range of about 2200° F.–2250° F. Although Alloy D was used, the teachings of this invention are applicable to γ' precipitation strengthened nickel-base superalloys in general, as noted previously.

In the processing of Alloy D in accordance with this invention, it is essential that the carbon become finely dispersed as carbide particles within the alloy. To do so involves rapid cooling from a melt, such as by powder metallurgy, spraycast forming or some other suitable rapid solidification processing techniques, or heating and working of a cast and wrought structure. For optimum properties, powder metallurgy particles are formed in a conventional manner by rapidly cooling a melt of Alloy D.

Billets are then produced using conventional extrusion consolidation methods, such as a 6:1 reduction in area, so as to yield a fully dense, fine grain billet preferably having at least about 98% theoretical density and a grain size of about ASTM 10 or finer, so as to achieve superplasticity. The billet is also characterized by a microstructure having the fine dispersion of the carbide phase. Importantly, soak times during subsequent heating must be limited so as to prevent coarsening of this phase once formed.

An article is then isothermally forged from the billet by hot upsetting the billet at a working temperature below the γ' solvus temperature, such as about 1900° F. to about 1950° F. so as to achieve a strain rate of below about 0.032 $sec^{-1}$, which is unexpectedly about 300 percent greater than that for Alloy D if alloyed to have a lower carbon content. In so doing, a grain size of no larger than about ASTM 10 is achieved, and local strain rates within the article are maintained below a critical strain rate for random grain growth. Importantly, the permitted range of strain rates noted above is significantly greater than would be possible if a carbon content of less than 0.045 weight percent was present in the alloy, such that a lower part rejection and scrap rate can be achieved in production, and such that higher production rates can be achieved.

A supersolvus heat treatment is then performed by preheating the article to the alloy's isothermal forging temperature, followed by a direct heating to a temperature above the γ' solvus temperature of the superalloy, generally on the order of about 2100° F., for a duration, generally about 1 hour, which is sufficient to uniformly coarsen the grains of the article to at least about ASTM 9. In accordance with known practices, the supersolvus heat treatment can be performed to achieve a uniform grain size within a range of about 2 or 3 ASTM units, such as about ASTM 7–8 without grains larger than ASTM 4, about ASTM 5–6 without grains larger than ASTM 2, or about ASTM 2–4 without grains larger than ASTM 00. As noted above, the carbide phase in the article serves to restrict grain boundary motion during the supersolvus heat treatment and thereby prevents random grain growth.

Thereafter, the article is preferably air cooled for a brief period on the order of a few minutes, and then quenched in oil or another suitable medium so as to reprecipitate γ' within the article, as is known in the art. In addition, the article may be aged using known techniques with a short stress relief cycle at a temperature above the aging temperature of the alloy if necessary to reduce residual stresses. As an alternative to oil quenching, fan air cooling may be employed. The resulting article generally has a stabilized microstructure and an enhanced, attractive balance and combination of tensile, creep, stress rupture, low cycle fatigue and fatigue crack growth properties, particularly for use from ambient up to a temperature of about 1400° F. The aging process required for a particular material and properties would be known to one skilled in the art and will not discussed further. However, as an illustrative example of an aging process for Alloy D, the worked article would be aged at a temperature of between about 1200° F. and about 1600° F., particularly about 1400° F. for approximately 8 hours, followed by air cooling, so as to achieve an ultimate tensile strength of greater than about 200 ksi at 750° F. and a yield strength at 0.2% offset of greater than about 160 ksi at 750° F.

As indicated above, the forging parameters made possible by this invention are significantly less stringent than parameters taught in the prior art as a result of the advantageous aspects of this invention. Consequently, the method of this invention makes possible the production of components from a γ' precipitation strengthened nickel-base superalloy at potentially lower costs. Furthermore, while powder metallurgy techniques are generally preferred, the method of this invention enables articles which are substantially free of critical grain growth, yet formed by less costly methods, such as spraycast forming techniques or worked cast and wrought structures.

From the above, it can be seen that the method of this invention for making γ' precipitation strengthened nickel-base superalloy articles from either powder metal, or cast and wrought material, serves to optimize the resultant worked microstructure after the deformation/working processes. By employing a minimum carbon content sufficient to pin approximately 10 percent of the grain boundary area, in conjunction with the processing techniques described, the grains are coarsened uniformly during subsequent heat treatment at the supersolvus solutioning temperature, and critical grain growth within the material is substantially prevented, such that a uniform grain size can be achieved within the article.

The method of this invention is also applicable to a wide range of starting input materials, including hot compacted powder, fine grain powder metal billet, coarse grain powder metal billet produced by supersolvus heat treatment of fine grain billet, as well as cast and wrought materials. In addition, the composition of the γ' precipitation strengthened nickel-base superalloy may vary widely so as to include alloys of this type having calculated high volume fractions of γ' content, varying from about 30 to about 65 volume percent.

In addition, other processing techniques of high volume fraction γ' superalloys, besides the powder metallurgy and hot forging operations disclosed, may be employed, such as using hot isostatically pressed powder, rapidly solidified materials, or fine grain wrought materials.

The teachings of this invention are advantageous in that components, such as turbine disks, fasteners and high pressure compressor blades and vanes, can be produced which are characterized by uniform grain size so as to have good strength, fatigue and creep resistance. By maintaining the temperature, strain rate and strain within predetermined limits, powder metal or cast and wrought superalloys may be forged and subsequently supersolvus heat treated to form uniform microstructures having desirable properties. These teachings can be extended to other applications requiring enhanced properties at temperatures ranging from ambient up to about 1400° F.

Finally, the method of this invention can be extended to the use of other second phase particles within a nickel-base superalloy for the purpose of pinning the grain boundaries of the alloy during supersolvus heat treatment. For example, the inclusion of yttrium at minimum levels of about 27 parts per million (ppm) nominal, or about 25 to about 30 ppm has been found to form sufficient quantities of yttria to perform the same function as that of the MC carbides. An upper limit for the addition of yttrium is about 2000 ppm, which is generally the point at which excessive yttria content leads to embrittlement, as is known in the prior art.

In addition, other phases also appear to advantageously interact with carbon to control critical grain growth. For example, boride phases formed primarily from molybdenum may also form at prior particle boundaries and grain boundaries, such that a higher level of boron can partially compensate for a low level of carbon in a superalloy. Experiments in which Alloy A of Table I has been alloyed to contain a carbon level of about 0.015 weight percent have resulted in critical grain growth if about 0.015 weight percent boron is present, but not if about 0.030 weight percent boron is present.

Oxide phases formed by changes in the melting and atomization practice may also favorably interact with carbon to control critical grain growth. For example, laboratory-scale heats with higher oxygen contents are more resistant to critical grain growth than full-scale production powder heats made with lower, commercially available oxygen levels. It is believed that the increased levels of alumina and zirconia result in a larger fraction of coverage of the prior particle boundary areas, or may act as nucleation sites for carbide precipitation.

Therefore, while our invention has been described in terms of a preferred embodiment, it is apparent that other forms could be adopted by one skilled in the art, such as by substituting other γ' precipitation strengthened nickel-base superalloys, or by substituting other processing steps or forms of the desired materials. Accordingly, the scope of our invention is to be limited only by the following claims.

What is claimed is:

1. A method for processing a γ' precipitation strengthened nickel-base superalloy so as to minimize nucleation tendencies and control grain growth in an article formed therefrom, the superalloy including a second phase in sufficient amounts to prevent critical grain growth in the superalloy when the superalloy is subjected to temperatures above its γ' solvus temperature, the method comprising the steps of:

providing a nickel-base superalloy alloyed to contain at least about 0.030 weight percent carbon or at least about 27 ppm yttrium so as to produce a volume fraction of a second phase, the superalloy further having a γ' solvus temperature, an incipient melting temperature, and a calculated γ' content in the range of about 30 to about 65 volume percent;

processing the superalloy so as to form an article characterized by a fine dispersion of the second phase and by a microstructure of grains of about ASTM 10 or finer;

working the article at a working temperature below the γ' solvus temperature;

preheating the article to the working temperature for a duration insufficient to cause coarsening of the fine dispersion of the second phase;

performing a supersolvus heat treatment by heating the article from the working temperature to a temperature above the γ' solvus temperature of the superalloy for a duration sufficient to uniformly coarsen the grains of the article to at least about ASTM 9 without coarsening the second phase, such that the second phase in the superalloy serves to restrict grain boundary motion during the supersolvus heat treatment and thereby prevents random grain growth; and cooling the article at a rate sufficient to reprecipitate γ' within the article;

wherein the working, preheating and supersolvus heat treatment steps are conducted such that coarsening of the second phase does not occur and the fine dispersion of the second phase is maintained in the article.

2. A method as recited in claim 1 wherein a sufficient amount of the second phase is formed such that a minimum of about 10 percent of the grain boundary area is covered with the second phase.

3. A method as recited in claim 1 wherein the processing step comprises forming powder metallurgy particles by rapidly cooling a melt of the γ' precipitation strengthened nickel-base superalloy.

4. A method as recited in claim 1 wherein the processing step comprises extrusion consolidation of the nickel-base superalloy so as to produce a billet having at least about 98% theoretical density.

5. A method as recited in claim 1 wherein the working step comprises an isothermal forging operation.

6. A method as recited in claim 1 wherein the processing step comprises heating and working a cast and wrought structure formed from the nickel-base superalloy.

7. A method as recited in claim 1 wherein the processing step comprises a spraycast operation to form an article from the nickel-base superalloy.

8. A method as recited in claim 1 further comprising an aging step after the cooling step, wherein the aging step heats the article to a temperature and for a duration sufficient to stabilize the microstructure of the article, so as to render the article suitable for use at elevated temperatures of up to about 1400° F.

9. A method for processing a γ' precipitation strengthened nickel-base superalloy so as to minimize nucleation tendencies and control grain growth in an article formed therefrom, the superalloy including a second phase in sufficient amounts to prevent critical grain growth in the superalloy when the superalloy is subjected to temperatures above its γ' solvus temperature, the method comprising the steps of:

providing a nickel-base superalloy alloyed to contain at least about 0.030 weight percent carbon so as to produce a volume fraction of carbides of the MC type such that a minimum of about 10 percent of the grain boundary area is covered with the carbides, the superalloy further having a γ' solvus temperature, an incipient melting temperature, and a calculated γ' content in the range of about 30 to about 65 volume percent;

processing the superalloy so as to form an article characterized by a fine dispersion of the carbide phase and by a microstructure of grains of about ASTM 10 or finer, a sufficient amount of the carbide phase being formed such that a minimum of about 10 percent of the grain boundary area is covered with the carbide phase;

working the article at a working temperature below the γ' solvus temperature;

preheating the article to a hold temperature approximately equal to the working temperature for a duration insufficient to cause coarsening of the fine dispersion of the carbide phase;

performing a supersolvus heat treatment by heating the article from the hold temperature to a temperature above the γ' solvus temperature of the superalloy for a duration sufficient to uniformly coarsen the grains of the article to a grain size range of about 2 to 3 ASTM units without coarsening the carbide phase, such that the carbide phase in the superalloy serves to restrict grain boundary motion during the supersolvus heat treatment and thereby prevents random grain growth in excess of about 2 ASTM units courser than the grain size range; and cooling the article at a rate sufficient to reprecipitate γ' within the article;

wherein the working, preheating and supersolvus heat treatment steps are conducted such that coarsening of the carbide phase does not occur and the fine dispersion of the carbide phase is maintained in the article.

10. A method as recited in claim 9 wherein the processing step comprises forming powder metallurgy particles by rapidly cooling a melt of the γ' precipitation strengthened nickel-base superalloy, the carbide phases being finely dispersed in the powder metallurgy particles during the rapid cooling of the melt.

11. A method as recited in claim 9 wherein the processing step comprises extrusion consolidation of the nickel-base superalloy so as to produce a billet having at least about 98% theoretical density and a microstructure characterized by a fine dispersion of the carbide phase and by grains of about ASTM 10 or finer.

12. A method as recited in claim 9 wherein the working step comprises an isothermal forging operation.

13. A method as recited in claim 9 wherein the processing step comprises heating and working a cast and wrought structure formed from the nickel-base superalloy.

14. A method as recited in claim 9 wherein the processing step comprises a spraycast operation to form an article from the nickel-base superalloy.

15. A method as recited in claim 9 further comprising an aging step after the cooling step, wherein the aging step heats the article to a temperature and for a duration sufficient to stabilize the microstructure of the article, so as to render the article suitable for use at elevated temperatures of up to about 1400° F.

* * * * *